United States Patent [19]

Suzuki et al.

[11] 4,436,072

[45] Mar. 13, 1984

[54] FUEL INJECTION CONTROL IN AN INTERNAL-COMBUSTION ENGINE

[75] Inventors: Yukio Suzuki; Kunihiko Sato; Motoyasu Muramatsu, all of Toyota, Japan

[73] Assignee: Toyota Jidosha Kabushiki Kaisha, Toyota, Japan

[21] Appl. No.: 450,044

[22] Filed: Dec. 15, 1982

[30] Foreign Application Priority Data

Mar. 29, 1982 [JP] Japan ..... 57-49196

[51] Int. Cl.[3] ..... F02B 3/00; F02P 5/04

[52] U.S. Cl. ..... 123/488; 123/418; 123/352; 123/419; 123/480; 123/494; 180/170

[58] Field of Search ..... 180/170, 174, 178, 179; 123/488, 418, 352, 419, 480, 422

[56] References Cited

U.S. PATENT DOCUMENTS

| | | | |
|---|---|---|---|
| 3,809,028 | 5/1974 | Luchaco | 180/170 |
| 4,337,744 | 7/1982 | Seeger et al. | 123/422 |
| 4,355,614 | 10/1982 | Hayashi | 123/488 |

*Primary Examiner*—Ronald B. Cox

*Attorney, Agent, or Firm*—Cushman, Darby & Cushman

[57] ABSTRACT

In the control of fuel injection in an internal-combustion engine, whether or not the rate of change of the engine rotational speed exceeds the selected limit of the rate of change of the engine rotational speed, determined by the ratio of the engine rotational speed to the automobile speed and the ratio of the intake air amount to the engine rotational speed, is checked. The value of the engine rotational speed used in the control of the fuel injection pulse width and the ignition timing is restricted to within the selected limit of the rate of change of the engine rotational speed.

3 Claims, 7 Drawing Figures

FUEL INJECTION CONTROL IN AN INTERNAL-COMBUSTION ENGINE

BACKGROUND OF THE INVENTION

1. Field of the Invention

The present invention relates to a method for controlling fuel injection in an internal-combustion engine. The method of the present invention is applicable to a spark ignition gasoline engine of the electronical fuel-injection-control type used for an automobile.

2. Description of Prior Art

In general, in an engine in which is used a control system in which the width of the fuel injection pulse or the ignition timing is calculated on the basis of the rotational speed of the engine, a problem exists in that when the variation of the rotational speed of the engine becomes large due to backlash of the gears of the driving system, twisting of the shaft, or deformation of the tires, the variation of the air-fuel ratio and the variation of the ignition timing become large. Hence, the variation of the torque of the engine becomes large, and, accordingly, the drivability of the automobile is deteriorated.

SUMMARY OF THE INVENTION

It is the object of the invention to provide an improved method for controlling fuel injection in an internal-combustion engine in which the air-fuel ratio and the ignition timing of the engine are stabilized and, accordingly, the drivability of the automobile is improved.

According to the fundamental feature of the present invention, there is provided a method for controlling fuel injection in an internal-combustion engine for an automobile in which the rate of change of the rotational speed of the engine is checked as to whether or not it exceeds the selected limit of the rate of change of the rotational speed of the engine, determined by the ratio of the rotational speed of the engine to the speed of the automobile and the ratio of the amount of intake air to the rotational speed of the engine, the value of the rotational speed of the engine used in the control of fuel injection being restricted to within said selected limit of the rate of change of the rotational speed of the engine and the width of the fuel injection pulse and the ignition timing of the engine being controlled by using said restricted value of the rotational speed of the engine.

DETAILED DESCRIPTION OF THE PREFERRED EMBODIMENT

Figure 1:
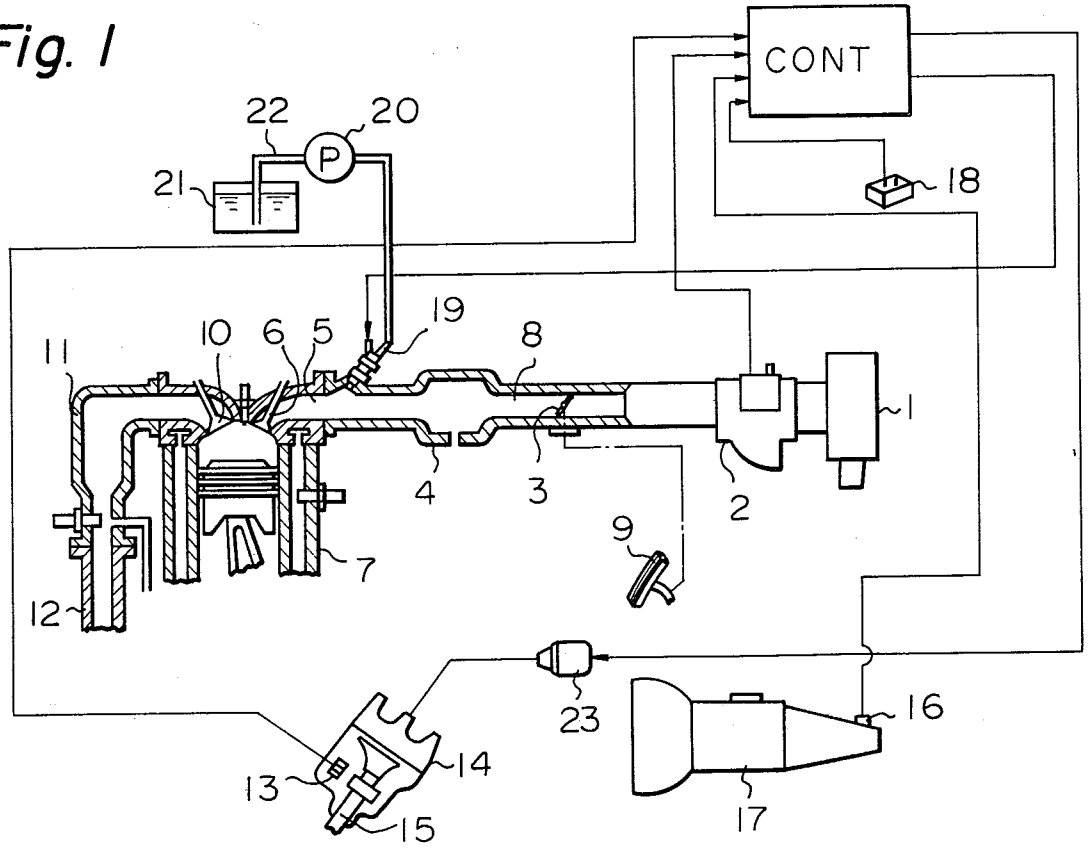
FIG. 1 illustrates an apparatus for controlling fuel injection in an internal-combustion engine according to an embodiment of the present invention.

The apparatus for controlling fuel injection in an internal-combustion engine according to an embodiment of the present invention, illustrated in FIG. 1, comprises an air cleaner 1, an air flow meter 2, a throttle valve 3, an acceleration pedal 9, an air intake pipe 8, a surge tank 4, an air intake port 5, a fuel injection valve 19, a fuel injection pump 20, a fuel path 22, a fuel tank 21, an engine body 7, a gas intake valve 6, an exhaust valve 10, an exhaust manifold 11, an exhaust pipe 12, an ignition coil 23, a distributor 14 having a shaft 15, a crank angle sensor 13, a control circuit CONT, an automatic transmission 17 having an automobile speed sensor 16, and a battery 18.

The air is taken in through the air cleaner 1 and the air flow meter 2 and is led to the air intake pipe 8 where the throttle valve 3 and the surge tank are provided. The air led to the air intake pipe 8 is mixed with the fuel injected from the fuel injection valve 19 at the air intake port 5, and the gas consisting of a mixture of air and fuel is supplied to the combustion chamber of the engine body 7 when the gas intake valve 6 is opened. The combusted gas is led to the exhaust manifold 11 when the exhaust valve 10 is opened and then is exhausted from the exhaust pipe 12.

The signal representing the amount Q of the intake air from the air flow meter 2, the signal representing the rotational speed N of the engine from the crank angle sensor 13, and the signal representing the speed V of the automobile from the automobile speed sensor 16 are supplied to the control circuit CONT.

The signal for controlling fuel injection, produced in the control circuit CONT, is supplied to the fuel injection valve 19.

Figure 2:
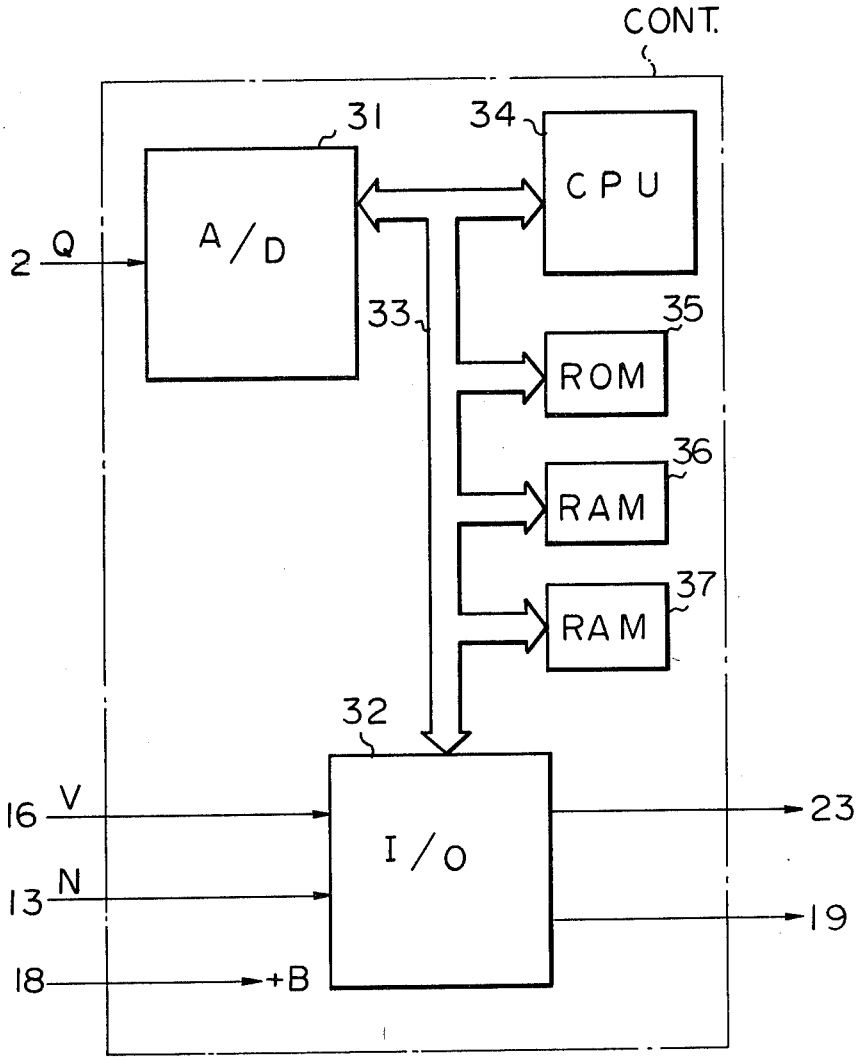
FIG. 2 illustrates the structure of the control circuit in the apparatus of FIG. 1.

As illustrated in FIG. 2, the control circuit CONT of the apparatus of FIG. 1 comprises an analog-to-digital (A/D) converter circuit 31 with a multiplexer, an input-output (I/O) circuit 32 with a buffer, a bus line 33, a central processing unit (CPU) 34, a read only memory (ROM) 35, and random access memories (RAMs) 36 and 37.

The A/D converter circuit 31 receives the signal of the intake air amount Q from the air flow meter 2. The I/O circuit 32 receives the signal of the automobile speed V from the automobile speed sensor 16 and the signal of the rotational speed N from the crank angle sensor 13 and produces the signal controlling fuel injection, which signal is supplied to the fuel injection valve 19, and the signal controlling the ignition coil 23.

In the control circuit CONT, the rate R in rpm/sec of change of the rotational speed of the engine is detected every predetermined number of rotations of the engine, and whether or not the detected rate of change of the rotational speed of the engine exceeds the threshold rate of change of the rotational speed determined by the value N/V and the value Q/N is checked. When it is detected that the rate of change of the rotational speed of the engine exceeds the threshold rate of change of the rotational speed, the rate of change of the rotational speed is brought to the determined threshold rate of change of the rotational speed so that the ignition timing and the width of the fuel injection pulse are controlled. The above-mentioned N/V is the ratio between the rotational speed of the engine and the speed of the automobile in rpm/km/hr. The above-mentioned Q/N is the ratio between the amount of intake air and the rotational speed of the engine in l/rev. Q/N is approximately proportional to the output torque of the engine.

Figure 3:
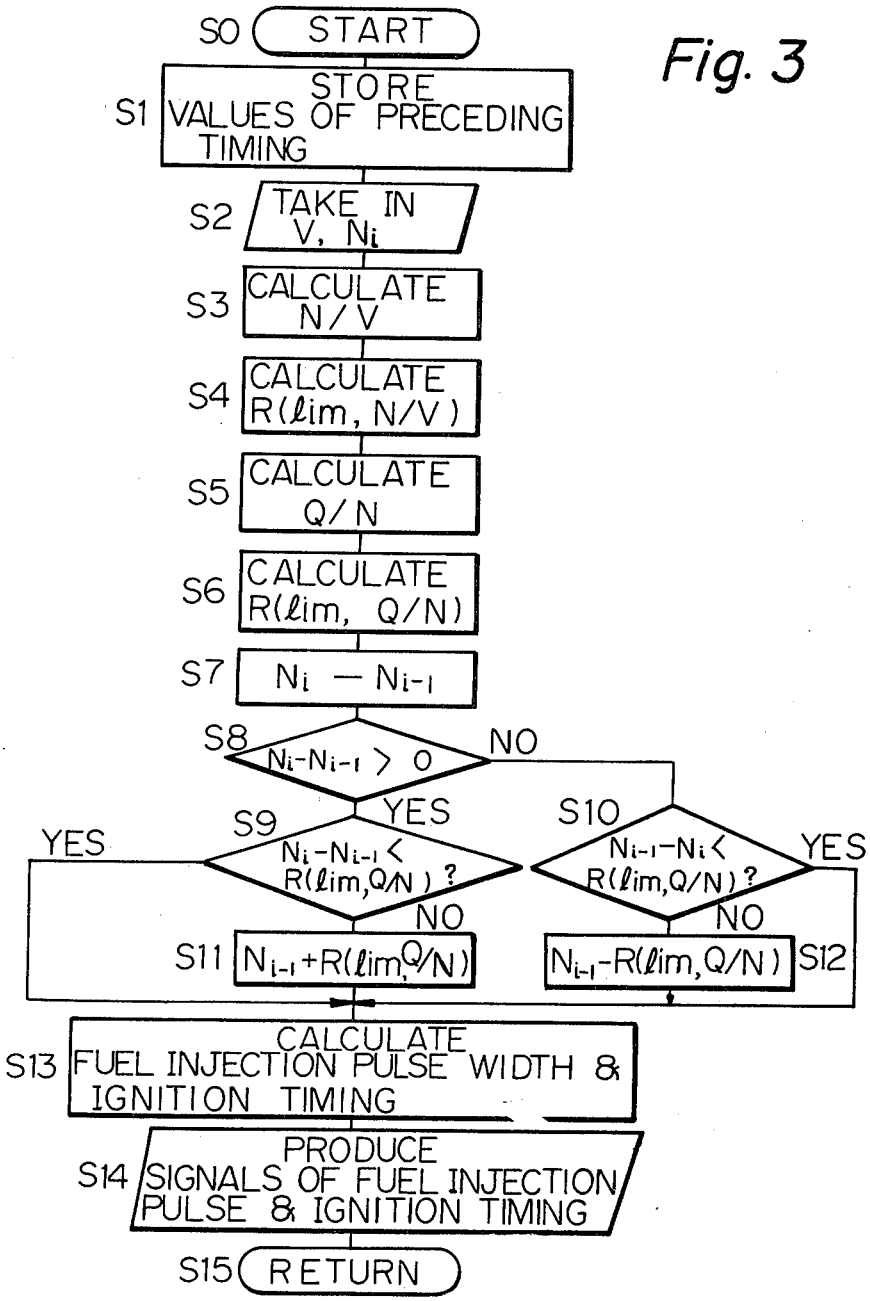
FIG. 3 illustrates a flow chart of an example of the calculation carried out in the control circuit.

A flow chart of an example of the calculation carried out in the control circuit CONT is shown in FIG. 3.

The calculation is carried out at each calculation timing determined according to the crank angle position of the rotation of the crankshaft of the engine. In step S0, the calculation routine is started. In step S1, the automobile speed $V_{i-1}$ at the preceding timing and the engine rotational speed $N_{i-1}$ at the preceding timing are stored. In step S2, the automobile speed $V_i$ at the present timing and the engine rotational speed $N_i$ at the present timing are taken in.

In step S3, the ratio $N_i/V_i$ is calculated. In step S4, the limit R (lim, N/V) of the rate R of change of the rotational speed is calculated by using N/V according to the following equation $$R\ (\text{lim}, N/V) = C_1 \cdot \frac{N}{V} + C_2 \quad (1)$$

Figure 4:
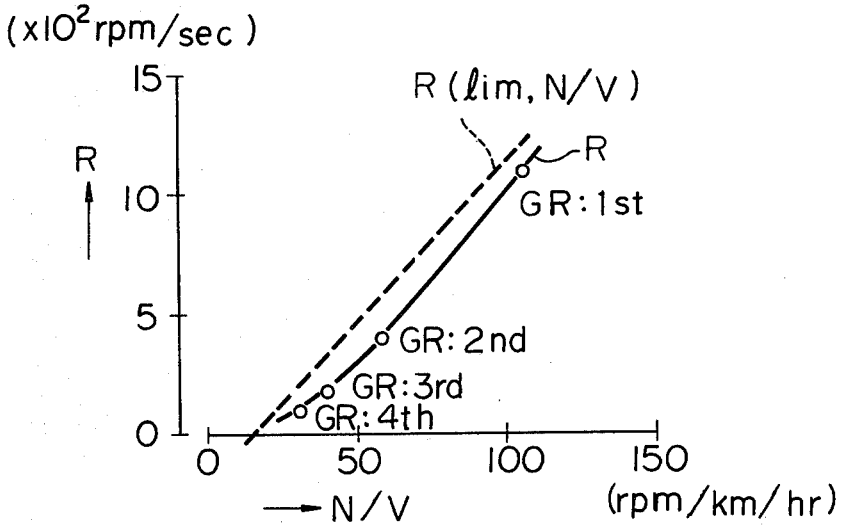
FIGS. 4 and 5 illustrate the characteristic of the rate of change of the engine rotational speed with respect to N/V and Q/N.

Equation (1) is obtained from the characteristic of the limit of the rate R of change of the rotational speed with respect to N/V illustrated in the graph of FIG. 4. The values $C_1$ and $C_2$ are constants, respectively. For example, $C_1=16$, and $C_2=200$.

In step S5, the value Q/N is taken in. In step S6, the limit R (lim, Q/N) of the rate R of change of the rotational speed with respect to Q/N is calculated according to the following equation $$R\ (\text{lim}, Q/N) = \left(C_1 \cdot \frac{N}{V} + C_2\right) \cdot \left(\frac{Q}{N}\right)^2 \quad (2)$$

Figure 5:
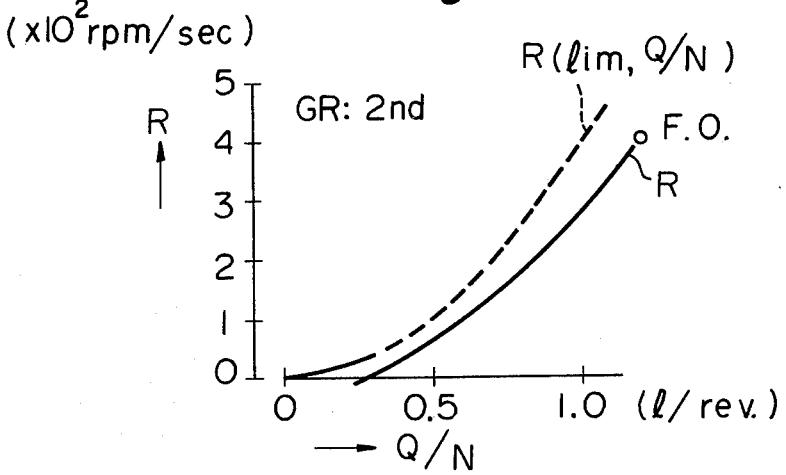

Equation (2) is obtained from the characteristic of the limit of the rate R of change of the rotational speed with respect to Q/N illustrated in the graph of FIG. 5. The values $C_1$ and $C_2$ are the same as $C_1$ and $C_2$ in equation (1), respectively.

In step S7, the difference between the engine rotational speed $N_i$ at the present timing and the engine rotational speed $N_{i-1}$ at the preceding timing is obtained. In step S8, it is decided whether or not the obtained difference is positive. If the decision is YES, the process proceeds to step S9, and if the decision is NO, the process proceeds to step S10.

In step S9, it is decided whether or not "$N_i-N_{i-1}$" is less than "R (lim, Q/N)". If the decision is YES, the process proceeds to step S13, and if the decision is NO, the process proceeds to step S11. In step S10, it is decided whether or not "$N_{i-1}-N_i$" is less than "R (lim, Q/N)". If the decision is YES, the process proceeds to S13, and if the decision is NO, the process proceeds to step S12.

In step S11, the value of the engine rotational speed is selected as "$N_{i-1}$+R (lim, Q/N)". In step S12, the value of tne engine rotational speed is selected as "$N_{i-1}$−R (lim, Q/N)".

In step S13, the width of the fuel injection pulse for electronical fuel-injection control and the ignition timing are calculated. In step S14, the output signals of the fuel injection pulse and the ignition pulse are produced. In step S15, the routine is completed.

In the calculation shown in the flow chart of FIG. 3, the rate of change of the engine rotational speed is restricted to within a selected limit only if the engine rotational speed is increased.

The characteristic of the rate of change of the engine rotational speed which represents the basis of equations (1) and (2) is illustrated in the graphs of FIGS. 4 and 5.

With regard to an automobile with a manual transmission (an M/T automobile), the rate of change of the engine rotational speed while the automobile is running is determined by the weight of the automobile, the running resistance, and the N/V ratio where N is the engine rotational speed and V is the automobile speed. The weight of the automobile and the running resistance depend on the particulars of the conditions of the automobile.

FIG. 4 illustrates a graph showing the change of the rate R of change of the rotational speed of the engine in rpm/sec according to the change of the ratio N/V in rpm/km/hr. The solid line in FIG. 4 represents the rate R of change of the rotational speed at a full load, and the points GR:1st, GR:2nd, GR:3rd, and GR:4th represent the points corresponding to the first, the second, the third, and the fourth gear, respectively. The broken line in FIG. 4 represents the selected limit r (lim, N/V) of the rate of change of the rotational speed with respect to N/V. For example, the straight broken line is obtained as an approximation of the line consisting of the points of the values which are approximately 5% increased values with regard to R of the solid line.

FIG. 5 illustrates a graph showing the change of the rate R of change of the rotational speed in rpm/sec according to the change of the ratio Q/N in l/rev, corresponding to the point GR:2nd (the second gear) on the solid line of FIG. 4. The solid line in FIG. 5 represents the rate R o change of the rotational speed. The broken line in FIG. 5 represents the selected limit R (lim, Q/N) of the rate of change of the rotational speed with respect to Q/N. The broken line is drawn as a curve of the second order. The point F.O. on the solid line corresponds to a throttle full-open state.

Figure 6A:
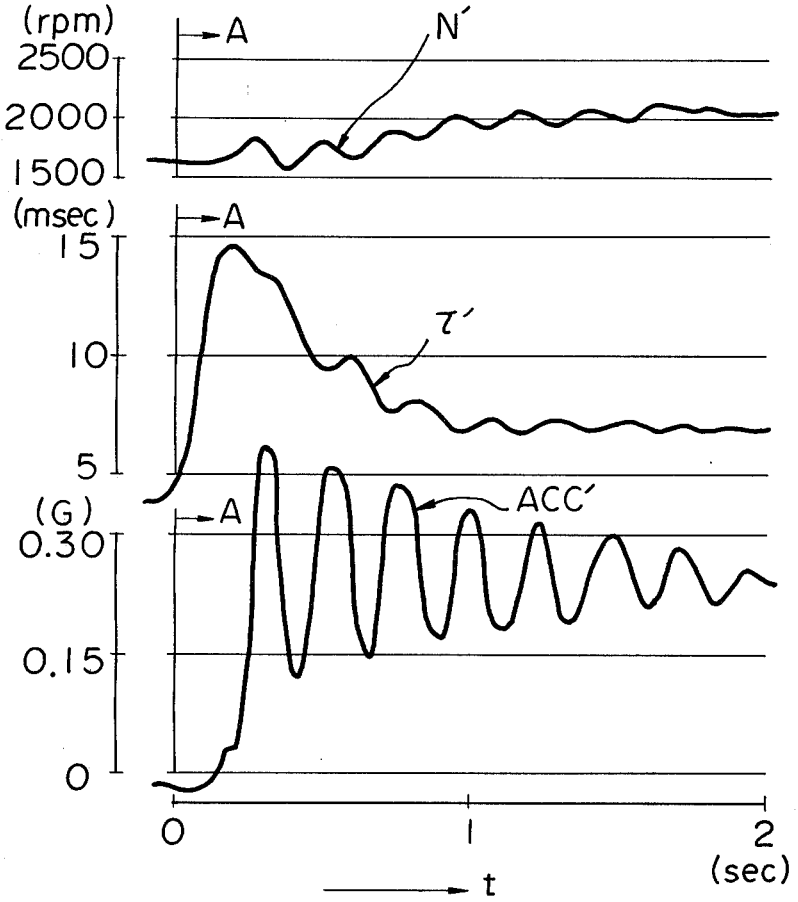
FIGS. 6A and 6B illustrate the operation characteristic of the apparatus of FIG. 1 together with that of the prior art apparatus.
Figure 6B:
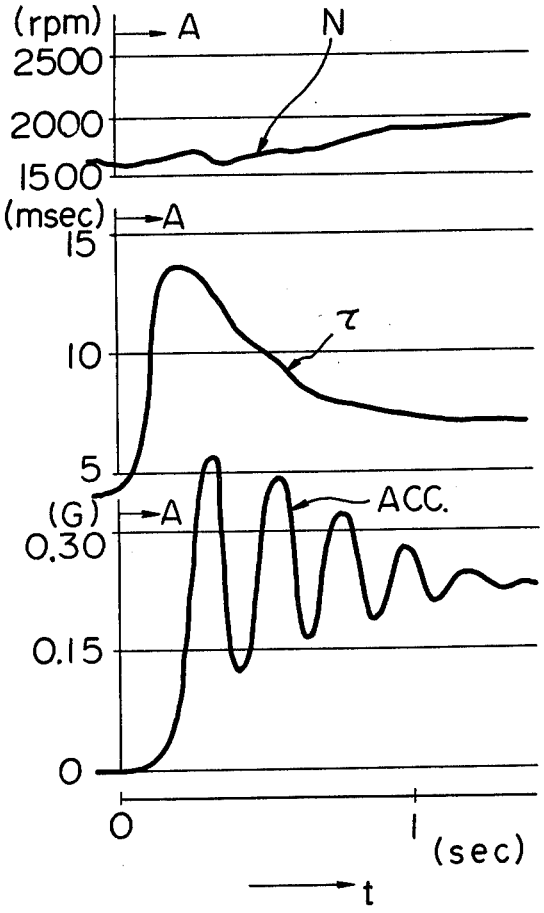

FIGS. 6A and 6B illustrate the operation characteristic of the apparatus of FIG. 1 together with that of the prior art apparatus. In FIGS. 6A and 6B, there are shown graphs of the engine rotational speed (N, N'), the width of the fuel injection pulse ($\tau$, $\tau'$), and the acceleration (ACC, ACC') in the case where a quick acceleration (A) of a manual transmission-type automobile from the constant speed running in second gear takes place.

The operation characteristic of the prior art apparatus is illustrated in FIG. 6A. As shown in the figure, the rotational speed N' of the engine is varied within the range of approximately 200 r.p.m. due to the variaton of the torque of the engine after quick acceleration A, and, in synchronization with the variation of the torque, the width $\tau'$ of the fuel injection pulse is varied. Thus, the period of attenuation of oscillation of the acceleration ACC', which represents the oscillation of the body of the automobile in the running direction, is as large as approximately 2 seconds (ACC' in FIG. 6A), and, accordingly, the drivability of the automobile is relatively poor.

The operation characteristic of the apparatus of FIG. 1 is illustrated in FIG. 6B. The graphs of FIG. 6B represent a case where control is carried out only with respect to an increase of the engine rotational speed N. As illustrated in FIG. 6B, the rotational speed N of the engine is not quickly varied, and the width $\tau$ of the fuel injection pulse is varied smoothly. Thus, the period of attenuation of oscillation of the acceleration ACC is reduced to approximately 1.2 seconds (ACC in FIG. 6B), and, accordingly, the drivability of the automobile is improved.

We claim:

1. A method for controlling fuel injection in an internal-combustion engine for an automobile in which the rate of change of the rotational speed of the engine is checked as to whether or not the rate of change of the rotational speed of the engine exceeds the selected limit of the rate of change of the rotational speed of the engine, determined by the ratio of the rotational speed of the engine to the speed of the automobile and the ratio of the amount of intake air to the rotational speed of the engine, the value of the rotational speed of the engine used in the control of fuel injection being restricted to within said selected limit of the rate of change of the rotational speed of the engine and the width of the fuel injecton pulse and the ignition timing of the engine being controlled by using said restricted value of the rotational speed of the engine.

2. A method as defined in claim 1, wherein said method comprises the steps of:

detecting and storing the values of the rotational speed of the engine, the speed of the automobile, and the amount of intake air at each calculation timing in the rotation of the crank-shaft of the engine, calculating the ratio of the rotational speed of the engine to the speed of the automobile, calculating the limit of the variation of the rotational speed of the engine with respect to the calculated ratio of the rotational speed of the engine to the speed of the automobile, calculating the ratio of the amount of intake air to the rotational speed of the engine, calculating the limit of the rate of change of the rotational speed of the engine on the basis of the calculated ratio of the amount of intake air to the rotational speed of the engine, calculating the difference between the rotational speed of the engine at the present timing and the rotational speed of the engine at the preceding timing, deciding whether or not the calculated difference of the rotational speed of the engine exceeds the calculated limit of the rate of change of the rotational speed of the engine with respect to the calculated ratio of the amount of intake air to the rotational speed of the engine, restricting the value of the rotational speed of the engine of the present timing used in the control of fuel injection to within the calculated limit of the rate of change of the rotational speed of the engine on the basis of the calculated ratio of the amount of intake air to the rotational speed of the engine when the rate of change of the rotational speed of the engine tends to exceed said calculated limit, and calculating the width of the fuel injection pulse and the ignition timing of the engine on the basis of said restricted value of the rotational speed of the engine.

3. An apparatus for carrying out the method defined in claim 2, wherein said apparatus comprises:

a means for detecting the amount of intake air of the engine, a means for detecting the rotational speed of the engine, a means for detecting the speed of the automobile, a control circuit means responsive to the signals from said intake air amount detecting means, said engine rotational speed detecting means, and the automobile speed detecting means for calculating the width of the fuel injection pulse and the ignition timing of the engine on the basis of the calculated limit of the rate of change of the rotational speed of the engine, and a fuel injection means and an ignition means receiving the output signals of said control circuit means having said calculated fuel injection pulse width and ignition timing.

* * * * *